US006819905B2

(12) United States Patent
Yamatani

(10) Patent No.: US 6,819,905 B2
(45) Date of Patent: Nov. 16, 2004

(54) IMAGE FORMING APPARATUS

(75) Inventor: Mitsuru Yamatani, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/378,595

(22) Filed: Mar. 5, 2003

(65) Prior Publication Data

US 2003/0170058 A1 Sep. 11, 2003

(30) Foreign Application Priority Data

Mar. 7, 2002 (JP) ..... 2002-062141

(51) Int. Cl.[7] ..... G03G 21/00
(52) U.S. Cl. ..... 399/350; 399/351
(58) Field of Search ..... 15/256.51, 256.52, 15/256.5; 399/102, 343, 349, 350, 351, 358, 360

(56) References Cited

U.S. PATENT DOCUMENTS

| | | | | |
|---|---|---|---|---|
| 4,292,387 A | | 9/1981 | Kanbe et al. | 430/102 |
| 4,356,245 A | | 10/1982 | Hosono et al. | 430/122 |
| 5,240,803 A | | 8/1993 | Ota | 430/106 |
| 5,721,433 A | | 2/1998 | Kosaka | 250/573 |
| 5,800,959 A | | 9/1998 | Ikami | 430/126 |
| 6,418,297 B1 | | 7/2002 | Yamatani et al. | 399/358 |
| 6,459,866 B1 | * | 10/2002 | Meguro | 399/102 |
| 6,480,695 B2 | * | 11/2002 | Endo et al. | 399/349 |

FOREIGN PATENT DOCUMENTS

| | | |
|---|---|---|
| JP | 54-42141 | 4/1979 |
| JP | 55-18656 | 2/1980 |
| JP | 3-84558 | 4/1991 |
| JP | 3-229268 | 10/1991 |
| JP | 4-1766 | 1/1992 |
| JP | 4-102863 | 4/1992 |
| JP | 8-136439 | 5/1996 |
| JP | 9-26672 | 1/1997 |

* cited by examiner

*Primary Examiner*—Hoang Ngo
(74) *Attorney, Agent, or Firm*—Fitzpatrick, Cella, Harper & Scinto

(57) ABSTRACT

In an image forming apparatus including a rotatable image bearing member, an image forming unit for forming a developer image, a transfer unit for transferring the developer image on the image bearing member, a cleaning member in contact with the image bearing member, and a developer recovering container with an aperture directed downward in the direction of gravity, the developer has a substantially spherical shape.

3 Claims, 5 Drawing Sheets

IMAGE FORMING APPARATUS

BACKGROUND OF THE INVENTION

1. Field of the Invention

The present invention relates to an image forming apparatus such as a copying machine, a printer or a facsimile apparatus, provided with a cleaning apparatus in which a cleaning blade is maintained in contact with an image bearing member such as an image bearing member or an electrostatic recording dielectric member (hereinafter also called a photosensitive member) to remove used toner on the image bearing member.

2. Related Background Art

In the image forming apparatus of this kind, an electrostatic latent image formed on the surface of a running image bearing member is developed as a toner image by developing means, and such toner image is transferred onto a transfer material, while the toner which is not transferred onto the transfer material but remains on the surface of the image bearing member is cleaned and removed by the cleaning apparatus. In such cleaning apparatus, a cleaning blade formed by an elastic member such as of polyurethane rubber is commonly used widely in the related art as the cleaning means for the remaining toner, and such cleaning blade is used because it is simple and compact in structure and also advantageous in cost.

Recently, for the purpose of compactization of the apparatus and reducing the discharge time of a first print, the image forming apparatus is employing a configuration in which a recording sheet (transfer sheet) is conveyed vertically (in the direction of gravity) from below to above. In such image forming apparatus, an aperture of the cleaning apparatus is directed downwards.

When an image bearing member 72 is rotated in a direction indicated by an arrow R, the surface of the image bearing member 72 is uniformly charged by a charger 73. The charged portion is subjected to an optical image exposure by an optical signal generating apparatus 74 to form an electrostatic latent image. The electrostatic latent image, upon passing a developing apparatus 75, is developed into a visible image with developing toner. The toner image thus formed is transferred by transfer means 79 onto a transfer paper (hereinafter also called transfer material) P, and the transfer paper P after the transfer is separated from the image bearing member 72 and, after fixing in fixing means, discharged onto a discharge tray 94 by paired discharge rollers 82.

The untransferred toner remains on the surface of the image bearing member 72 after the transfer, and such toner T is scraped off by a cleaning blade 84 of a cleaning apparatus 83 in contact with the surface of the image bearing member 72. A scooping sheet 86 is provided in order to prevent leakage of the toner T from the cleaning unit.

In the above-mentioned cleaning apparatus 83, because a cleaning container has a downward aperture, the toner T tends to stay by the gravity, in a portion formed by the image bearing member 72, the cleaning blade 84 and the scooping sheet 86. The cleaning apparatus 83 is provided with a screw 103 in order to discharge such stagnant toner, but the amount of the stagnant toner exceeds a toner discharging ability of the screw 103 in case sheets with a high print ratio are passed in a large amount. Therefore, in case the toner T continues, to stay in such state, there will result a situation where not only a satisfactory cleaning cannot be achieved but also the toner T overflows from the cleaning apparatus.

Also a distance from a contact position between the cleaning blade 84 and the image bearing member 74 to a contact position between the scooping sheet 86 and the image bearing member 74, namely an aperture between the front end of the cleaning blade and the front end of the scooping sheet, has to be finely set at about 1 mm in order to prevent toner leakage. In order to meet these requirements, it is necessary to improve a transfer rate at the transfer of the toner image from the image bearing member to the transfer material P.

Japanese Patent Application Laid-open No. 9-26672 discloses a method of reducing a volumic resistivity of the toner by including a transfer efficiency improving agent with an average particle size of 0.1 to 3 $\mu$m and hydrophobic fine silica powder of a BET specific surface area of 50 to 300 $m^2/g$ by a nitrogen adsorption method and improving the transfer efficiency by forming a thin film of the transfer efficiency improving agent on the photosensitive member. However, since the toner prepared by a crushing method has a particle size distribution, it is difficult to obtain an effect in all the particles and there is required a further improvement.

In order to obtain a toner shape closer to spherical as a method of improving the transfer efficiency, toner produced by a spray particle-forming method, a solution dissolving method, a polymerization method etc. is disclosed for example in Japanese Patent Application Laid-open No. 3-84558, Japanese Patent Application Laid-open No. 3-229268, Japanese Patent Application Laid-open No. 4-1766, Japanese Patent Application Laid-open No. 4-102863, etc. However, such toner producing methods not only require a large facility but also involve drawbacks on the cleaning because of a fact that the toner particles become closer to true spheres, and cannot be considered preferable for the sole purpose of improving the transferability.

The toner is generally formed by employing as raw materials, a binder resin for fixation to the transfer material, a colorant for forming a color in the toner, and a charge controlling agent for providing the particle with a charge, and, in case of so-called one-component developing method as disclosed in Japanese Patent Application Laid-open No. 54-42141 and Japanese Patent Application Laid-open No. 55-18656, additionally employing a magnetic material for providing the toner with a carrying property. Such materials are dry mixed together with other additives such as a releasing agent or a fluidity providing agent if necessary, then fused and kneaded in a general-purpose kneading apparatus such as a roll mill or an extruder, and, after solidification by cooling, the kneaded substance is crushed by a crushing apparatus such as jet flow crusher or a mechanical collision crusher. The obtained crude crushed substance is introduced into an air classifier for classification thereby providing a classified material with a particle size required as toner, which is dry mixed with an external additive such as a fluidizer or a lubricant if necessary to obtain toner usable for image formation.

In case of the toner to be used in a two-component developing method, the above-mentioned toner is mixed with magnetic carrier for use in the image formation. There is desired toner of a high developability with an improved transfer efficiency, for the purpose of reducing the toner remaining on the photosensitive member after the transfer and constituting the waste toner, including the productivity of the toner itself.

SUMMARY OF THE INVENTION

An object of the present invention is to provide an image forming apparatus capable of effectively preventing generation of defective cleaning, also in case of employing cleaning means in which a container has a substantially downward aperture in the direction of the gravity.

Another object of the present invention is to provide an image forming apparatus including:

image forming means which forms a developer image on a rotatable image bearing member;

transfer means which transfer the developer image on the image bearing member onto a transfer material; and cleaning means having a cleaning member maintained in contact with the image bearing member and a container of which an aperture for recovering the developer is substantially downward in the direction of gravity;

wherein the developer has a substantially spherical shape.

DESCRIPTION OF THE PREFERRED EMBODIMENTS

In the following, there will be explained an embodiment of the present invention.

Embodiment 1

Figure 2:
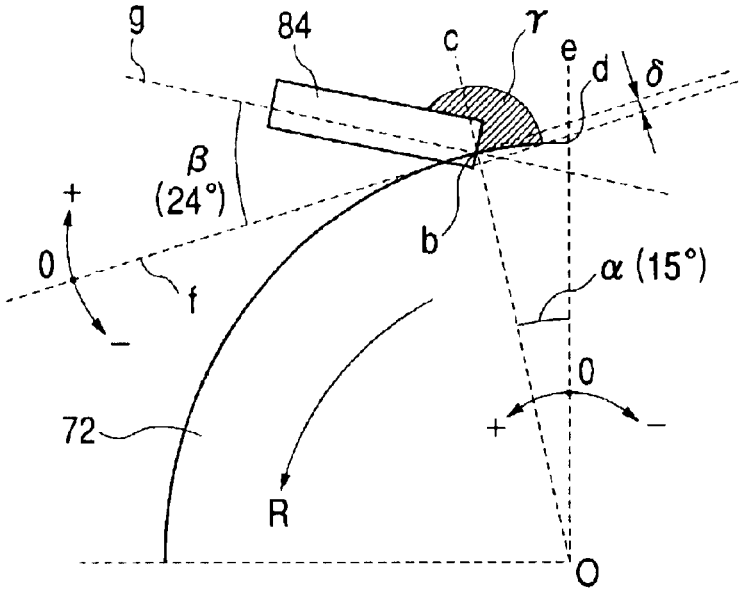
FIG. 2 is a view showing a setting of a cleaning blade.

A cleaning conditions is set for example as shown in FIG. 2. An angle $\alpha$ formed by a line c which connects a contact position (contact point) b between a cleaning blade 84 and a photosensitive drum 72 with a rotation center O of the photosensitive drum, and a line e which connects a highest point d of the photosensitive drum 72 with respect to a horizontal plane with the center O of the photosensitive drum, is selected as $-45° < \alpha < 60°$ (degree), preferably $-20°$ (degree)$<\alpha<20°$ (degree).

Under a condition $\alpha \geqq 60°$, there cannot be sufficiently secured a lubrication or a cleaning ability of a blade, obtained by accumulating the toner in an aperture of a cleaner. Also under a condition $-45° \geqq \alpha$, the cleaner is positioned close to a conveying path of the recording sheet, thereby easily leading a drawback of an interference between the cleaning apparatus and a paper passing unit in which the recording paper P passes flow below to above in the direction of gravity.

Also a contact angle (penetration angle) $\beta$ formed by a tangential direction f of the photosensitive drum 72 at the contact position b and a plane g of the cleaning blade 84 is $0° < \beta < 90°$, preferably $20° < \beta < 30°$. Sufficient cleaning cannot be executed under a condition $\beta \leqq 0°$ or $90° \leqq \beta$. Under a condition $\beta \leqq 0°$, the blade edge cannot be contacted under an appropriate pressure. Also under a condition $90° \leqq \beta$, there may result a drawback such as a turnover of the blade.

Figure 1:
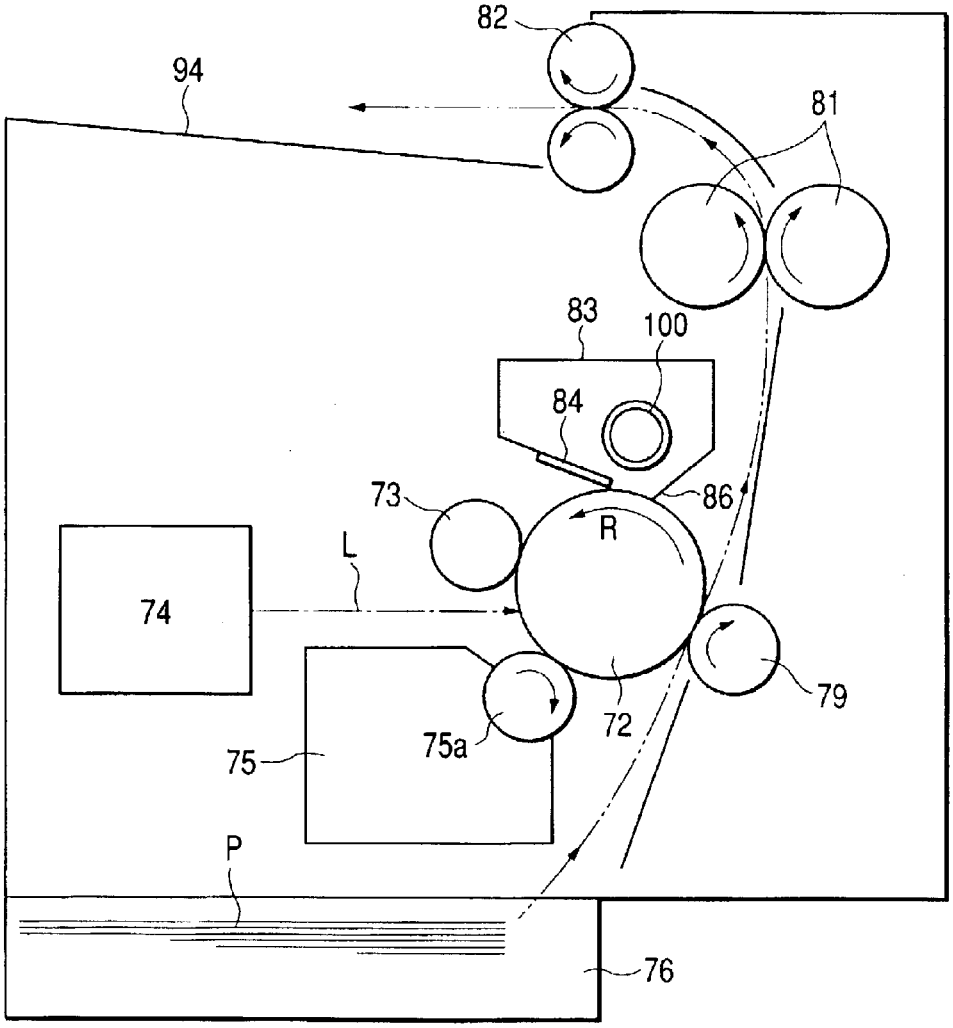
FIG. 1 is a view showing an entire configuration of an image forming apparatus of the present invention.

T indicates transfer retentive toner on the photosensitive drum 72, scraped off by the front end portion of the cleaning blade 84. In FIG. 1, there is provided a scooping sheet 86 which constitutes a toner leakage preventing member for preventing leakage of the toner T to the outside of the cleaning unit 83.

Figure 3:
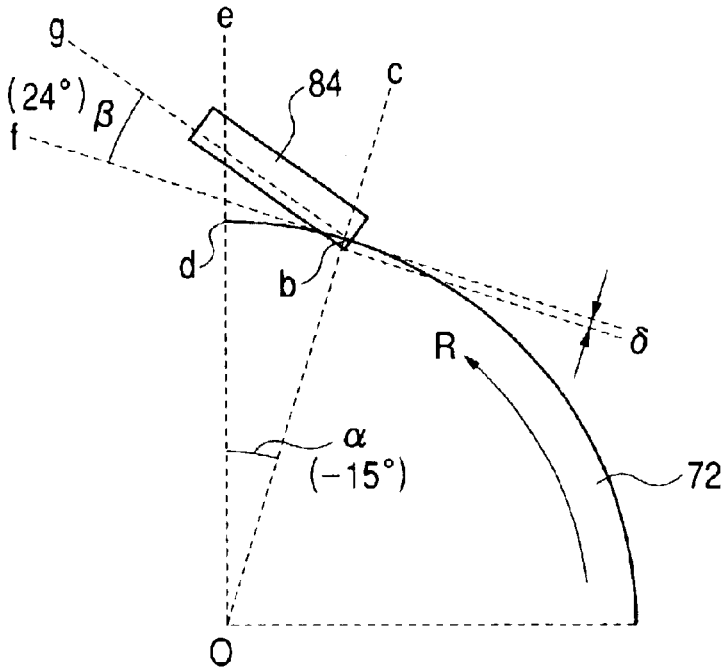
FIG. 3 is a view showing another setting of a cleaning blade.

The cleaning blade 84 is in fact bent at the contact position b, but the plane g of the cleaning blade is considered in an imaginary unbent line in defining the angle. $\delta$ indicates a penetration amount of the cleaning blade 84 into the photosensitive drum 72. FIG. 2 shows a state of $\alpha=15°$ and $\beta=24°$, while FIG. 3 shows a state of $\alpha=-15°$ and $\beta=24°$.

Figure 4:
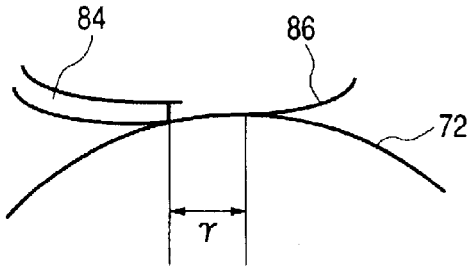
FIG. 4 is a view showing a contact state of a cleaning blade and a scooping sheet.

In an actual state, the cleaning blade 84 and the scooping sheet 86 are in contact with the photosensitive drum 72 in a bent state. FIG. 4 shows a contact state of the cleaning blade 84 and the scooping sheet 86 with the photosensitive drum 72. A distance $\gamma$ between the front end of the cleaning blade 84 and that of the scooping sheet 86 is selected as 0.5 mm$<\gamma<$10 mm, preferably 0.8 mm$<\gamma<$2 mm. Under a condition $\gamma \leqq 0.5$ mm, the cleaning blade 84 and the scooping sheet 86 mutually interfere during the cleaning operation to result in a cleaning defect, while, under a condition 10 mm$\leqq\gamma$, a toner leakage tends to occur.

It is already known that the shape of the toner influences various properties of the toner, but the present inventors have made investigations on the particle size and the shape of the toner T produced by a crushing method, and have found that a circularity is closely related with a transfer property, a developability (image quality) and a fixing property in particles of 3 $\mu$m or larger.

Also in order to attain a same effect with a toner T of a different particle size, it is necessary to control a weight-averaged diameter and the circularity in the particles of 3 $\mu$m or larger by a content of fine powder of 3 $\mu$m or less. Stated otherwise, there can be obtained a toner with excellent in transfer property, developing property (image quality) and fixing property, by defining the weight-averaged diameter and the circularity in the particles of 3 $\mu$m or larger with the content of fine powder of 3 $\mu$m or less.

More specifically, in a toner which has a weight-averaged diameter of 5 to 12 $\mu$m, and in which particles of a particle size of 4.0 $\mu$m or less constitute 40 number % or less and particles of a particle size of 10.0 $\mu$m or larger constitute 25 vol. % or less, it is preferred that, within the particles of a particle size of 3.0 $\mu$m or larger, particles having a circularity a determined by a following equation (1) constitute 90% or larger in number-based cumulative value:

$$\text{circularity } a = L0/L \tag{1}$$

wherein L0 is a circumferential length of a circle of a projection area same as that of a particle image, and L is a circumferential length of a particle image; and that a number-based cumulative value Y (%) of particles having a circularity of 0.950 or larger and a weight-averaged diameter X ($\mu$m) satisfy a following relation (2):

$$\text{number-based value } Y \text{ of particles with circularity } a \text{ of 0.950 or higher} \geqq \exp 5.51 \times X^{-0.645} \tag{2}$$

wherein weight-averaged particle size X: 5.0 to 12.0 $\mu$m.

Such circularity a enables easy charge control of the toner and achieves uniformity of charging and stability in durability. It is also found that such circularity a improves the transfer efficiency. This is because the toner having such circularity a as described above reduces the contact area between the toner particle and the photosensitive member, whereby an adhesion force between the toner and the photosensitive member is reduced. Also since a contact area between the toner particles is reduced because of a reduced specific surface area of the toner particles in comparison with that of the toner produced by a conventional collision type air flow crusher, the toner powder has a higher volumic density to improve thermal conduction at the fixing operation, thereby also attaining an effect of improving the fixing property.

Also, in case, among the toner particles of 3 μm and larger, the particles having a circularity a of 0.900 or larger constitute less than 90% in number-based cumulative value, the contact area between the toner particles and the photosensitive member increases to increase the adhesion force of the toner particles to the photosensitive member, whereby a sufficient transfer efficiency cannot be obtained.

Also, in case, among the toner particles of 3 μm and larger, the particles having a circularity a of 0.950 or larger do not satisfy, in number-based cumulative value:

number-based cumulative value $$Y \geqq \exp 5.51 \times X^{-0.645},$$

namely a case of:

number-based cumulative value $$Y < \exp 5.51 \times X^{-0.645},$$

the adhesion is accelerated to a fixing member or the like, whereby a sufficient transfer efficiency may not be obtained and the fluidity of toner may also be deteriorated.

As a scale for measuring the fluctuation of the particles having different circularities a, there may be employed a standard deviation SD. In the present invention, a standard deviation SD within a range from 0.030 to 0.045 is acceptable without problem.

The average circularity $\bar{a}$ is adopted as a simple method for representing a particle shape in quantitative manner. In the present invention, particles are measured with a flow type particle image analyzing apparatus FPIA-1000 manufactured by Toa Iyo Denshi Co., then a circularity a of the measured particles according to a following equation (1), and an average circularity is defined by a following equation (3) by dividing a sum of the circularities a of all the measured particles with a number of all the particles:

$$\text{Circularity } a = L0/L \tag{1}$$

wherein L0 is a circumferential length of a circle of a projection area same as that of a particle image, and L is a circumferential length of a particle image; and $$\text{Average circularity } \bar{a} = \sum_{i=1}^{m} ai/m \tag{3}$$

The circularity standard deviation SD can be calculated from a following equation (4):

$$\text{Circularity standard deviation } SD = \sum_{i=1}^{m} (a - ai)^2 / m^{1/2} \tag{4}$$

wherein $\bar{a}$ is the average circularity obtained from equations (1) and (3), ai is the circularity in each particle, and m is a number of the measured particles.

The circularity in the present invention is an index indicating a level of irregularity of the toner particle, and assumes a value 1.00 in case the toner particle is completely spherical but becomes smaller as the surface shape becomes more complex. Also the circularity standard deviation SD of a distribution of the circularity in the present invention is an index indicating a level of fluctuation, and becomes smaller for a sharper distribution.

The measuring apparatus "FPIA-1000" employed in the present invention, in the calculation of the average circularity $\bar{a}$ and the circularity standard deviation SD after the calculation of the circularity a of each particle, employs a calculation method of dividing the circularities a obtained from the particle measurement into 61 classes within a range of 0.4 to 1.0 and utilizing a center value and a frequency in each divided class for determining the average circularity $\bar{a}$ and the circularity standard deviation SD.

However, the errors respectively between the average circularity $\bar{a}$ and the circularity standard deviation SD obtained in this calculation method, and the average circularity $\bar{a}$ and the circularity standard deviation SD derived from the aforementioned calculation equation directly employing the circularity a of each particle are very small and are practically negligible, and, in the present invention, there may be employed such partly modified calculation method utilizing the concept of the method directly utilizing the circularity of each particle, for the data handling reason such as reduction of the calculation time and the simplification of the calculating formula.

In a specific method of measurement, 100 to 150 ml of water from which impurities are eliminated in advance are contained in a container, then a surfactant preferably an alkylbenzene sulfonate salt is added in an amount of 0.1 to 0.5 g as a dispersant and a measurement sample is added in an amount of about 0.1 to 0.5 g. A suspension of the sample is subjected to dispersion for about 1 to 3 minutes in an ultrasonic disperser, and, with a dispersion concentration of 1.2–2.0 particle/μl, and a circularity distribution is measured with the aforementioned flow type particle image measuring apparatus on particles having an equivalent circle diameter within a range from 0.6 μm to 159.21 μm. A concentration of the suspension maintained within a range of 12 to 20 thousand particle/μl allows to maintain a particle concentration capable of maintaining the precision of the apparatus even under a large cut ratio.

The outline of the measurement, as described in a catalog (June 1995 edition) of the apparatus FPIA-1000 issued by Toa Iyo Denshi Co., an operation manual of the measuring apparatus and Japanese Patent Application Laid-open No. 8-136439, is as follows.

A sample dispersion is passed along a flow path (spread along the direction of flow) in a flat transparent flow cell (about 200 μm in thickness). A strobe light and a CCD camera are positioned in respectively opposite sides across the flow cell, so as to form an optical path crossing the thickness of the flow cell. During a flow of the sample dispersion, a flash light irradiation is executed at an interval of 1/30 seconds for obtaining an image of the particles flowing in the flow cell, and each particle is photographed as a two-dimensional image having a certain area parallel to the flow cell. From an area of the two-dimensional image of each particle, there is calculated a diameter of a circle having a same area as an equivalent circle diameter. Then the circularity of each particle is calculated from the projected area of the two-dimensional image of each particle, utilizing the aforementioned calculating equation for the circularity.

In the following, there will be given a detailed explanation on the composition of the toner preferred for attaining the objects of the present invention.

A binder resin to be employed in the present invention can be a vinyl resin, a polyester resin or an epoxy resin. Among these, vinyl resin and polyester resin are particularly preferred in consideration of the charging property and the fixing ability.

The vinyl resin can be formed for example from styrene; a styrene derivative such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, or p-n-dodecylstyrene; an ethylenic unsaturated polyolefin such as ethylene, propylene, butylene or isobutylene; an unsaturated polyene such as butadiene; a halogenated vinyl such as vinyl chloride, vinylidene chloride, binyl bromide or vinyl fluoride; a vinylester such as vinyl acetate, vinyl propionate, or vinyl benzoate; an α-methylene aliphatic monocarboxylic acid ester such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, or diethylaminoethyl methacrylate; an acrylic acid ester such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, or phenyl acrylate; a vinyl ether such as binyl methyl ether, vinyl ethyl ether, or vinyl isobutyl ether; a vinyl ketone such as vinyl methyl ketone, vinyl hexyl ketone, or methyl isopropyl ketone; an N-vinyl compound such as N-vinylpyrol, N-vinylcarbazole, N-vinylindole or N-vinylpyrrolidone; a vinylnaphthalene; an acrylic acid derivative or a methacrylic acid derivative such as acrylonitrile, methacrylonitrile or acrylamide; an α, β-unsaturated acid ester; and a dibasic acid diester. Such vinyl monomers can be used singly or in a combination of two or more kinds.

Among these, there is preferred a combination of monomers providing a styrenic copolymer or a styrene-acryl copolymer.

Also, if necessary, there may be employed a polymer or a copolymer crosslinked with a crosslinkable monomer as shown in the following.

There can be employed an aromatic divinyl compound such as divinyl benzene or divinyl naphthalene; a diacrylate compound connected by an alkyl chain such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate or a foregoing compound in which acrylate is replaced by methacrylate; a diacrylate compound connected by an alkyl chain including an ether bond such as diethylene glycol diacrylate, triethylene glycol diacrylate, tetraethyelene glycol diacrylate, polyethylene glycol #400 diacrylate, polyethylene glycol #600 diacrylate, or a foregoing compound in which acrylate is replaced by methacrylate; a diacrylate compound connected by a chain including an aromatic group and an ether bond such as polyoxyethylene(2)-2,2-bis(4-hydroxyphenyl)-propane diacrylate, polyoxyethylene (2)-2,2-bis(4-hydroxyphenyl)-propane diacrylate, or a foregoing compound in which acrylate is replaced by methacrylate; or a polyester type diacrylate such as MANDA (trade name; Nihon Chemical Co.).

Also as a polyfunctional crosslinking agent, there can be employed pentaerythritol triacrylate, trimethylol ethane triacrylate, trimethylol propane triacrylate, tetramethylol methane tetraacrylate, oligoester acrylate or a foregoing compound in which acrylate is replaced by methacrylate; triallyl cyanurate or triallyl trimellitate.

Such crosslinking agent can be employed in 0.01 to 10 parts by mass (weight) (more preferably 0.03 to 5 parts by mass (weight)) with respect to 100 parts by mass of other monomer components.

Among these crosslinkable monomers, an aromatic divinyl compound (particularly divinylbenzene) or a diacrylate compound connected by a chain including an aromatic group and an ether bond can be advantageously employed as the resin for the toner, in consideration of a fixing property and an anti-offset property.

In the present invention, the aforementioned binder resin may be mixed, if necessary, with a homopolymer or a copolymer of a vinyl monomer, a polyester resin, a polyurethane resin, an epoxy resin, polyvinylbutyral, rosin, denatured rosin, a terpene resin, a phenolic resin, an aliphatic or alicyclic hydrocarbon resin, an aromatic petroleum resin etc.

In case of mixing two or more resins as the binder resin, it is preferred to mix those of different molecular weights in an appropriate proportion.

The binder resin has a glass transition temperature preferably in a range of 45 to 80° C., more preferably 55 to 70° C., a number-averaged molecular weight (Mn) preferably in a range of 2,500 to 50,000 and a weight-averaged molecular weight (Mw) preferably in a range of 10,000 to 1,000,000.

The binder resin composed of vinyl polymer or vinyl copolymer can be synthesized by a polymerization method such as block polymerization, solution polymerization, suspension polymerization, or emulsion polymerization. In case of employing a carboxylic acid monomer or an acid anhydride monomer, block polymerization or solution polymerization is preferred in consideration of the property of the monomer.

As an example, there can be employed a following method. A vinyl copolymer can be obtained by block polymerization or solution polymerization employing a monomer such as dicarboxylic acid, dicarboxylic acid anhydride, or dicarboxylic acid monoester. In solution polymerization, at the solvent elimination by distillation, a part of dicarboxylic acid or dicarboxylic acid monoester can be partly made anhydride by modifying the distilling condition. Also a vinyl copolymer obtained by block polymerization or solution polymerization can be further made as an anhydride by a heating process. Also an acid anhydride can be partly made an ester with a compound such as an alcohol.

Inversely it is also possible to hydrolyze thus obtained vinyl copolymer thereby forming a ring from an acid anhydride group, thereby forming dicarboxylic acid in a part.

On the other hand, a vinyl copolymer obtained from dicarboxylic acid monoester monomer by block polymerization or solution polymerization may be subjected to an anhydride formation by a heating process and a ring opening by a hydrolyzing process to obtain dicarboxylic acid from anhydride. Also in a method of dissolving a vinyl copolymer obtained by block polymerization or solution polymerization in a monomer and executing block polymerization or emulsion polymerization to obtain a vinyl monomer or a vinyl copolymer, a part, of acid anhydride executes a ring opening reaction to provide a dicarboxylic acid unit. It is also possible to add another resin in the monomer at polymerization, and the obtained resin can be esterified by an acid anhydride formation by a heating process and a ring opening process of acid anhydride by a treatment with weakly alkaline water.

Since a dicarboxylic acid monomer and a dicarboxylic acid anhydride monomer has a strong tendency of executing alternate polymerization, a following method is preferable for obtaining a vinyl copolymer in which functional groups such as an anhydride or a dicarboxylic acid are randomly dispersed. There is employed a method of executing solution polymerization with a dicarboxylic acid monoester monomer to obtain a vinyl copolymer, then dissolving such vinyl copolymer in a monomer, and executing suspension polymerization to obtain a binder resin. In this method, by a processing condition at the elimination of solvent by distillation after the solution polymerization, it is possible to form an anhydride by dealcoholation and ring closing of the entire polymer or the dicarboxylic acid monoester portion thereby obtaining an acid anhydride. In suspension polymerization, the acid anhydride group is hydrolyzed to undergo a ring opening, thereby providing dicarboxylic acid.

A generation or an extinction of acid anhydride can be confirmed since, in an acid anhydride formation in polymer, the infrared absorption of a carbonyl group is shifted to a higher wave number than in an acid or an ester.

The binder resin thus obtained can provide the toner with a satisfactory charging property, since carboxyl group, anhydride group and dicarboxylic acid group are uniformly dispersed in the binder resin.

As the binder resin, there is also preferred a polyester resin explained in the following.

In such polyester resin, an alcohol component constitutes 45 to 55 mol. % of all the components, and an acid component constitutes 55 to 45 mol. %.

The alcohol component can be, for example, ethylene glycol, propylene glycol, 1,3-butanediol, 14-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol-A, a bisphenol derivative represented by a following formula (B):

(B)

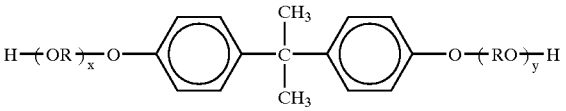

wherein R represents an ethylene group or a propylene group, x and y each independently represents an integer equal to or larger than 1, and an average value of x+y is within a range from 2 to 10;

a diol represented by a following formula (C):

(C)

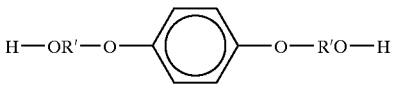

wherein R' represents $—CH_2CH_2—$, $—CH_2—C(CH_3)H—$ or $—CH_3—C(CH_3)_2—$;

or a polyhydric alcohol such as glycerin, sorbit or sorbitan.

Also divalent carboxylic acid representing 50 mol. % or more of all the acid component can be, for example, a benzenecarboxilic acid or an anhydride thereof such as phthalic acid, terephthalic acid, isophthalic acid or phthalic anhydride; an alkyldicarboxylic acid or an anhydride thereof such as succinic acid, adipic acid, cebasic acid, or azelaic acid; succinic acid substituted with an alkyl group or an alkenyl group with 6 to 18 carbon atoms or an anhydride thereof; an unsaturated dicarboxylic acid or an anhydride thereof such as fumaric acid, maleic acid, citraconic acid or itaconic acid; and a trivalent carboxylic acid can be trimellitic acid, pyromellitic acid, benzophenone tetracarboxylic acid or an anhydride thereof.

In a particularly preferred polyester resin, the alcohol component is a bisphenol derivative represented by the foregoing formula (B), and the acid component can be a dicarboxylic acid such as phthalic acid, terephthalic acid, isophthalic acid or anhydride thereof, succinic acid, n-dodecenylsuccinic acid or anhydride thereof, fumaric acid, maleic acid, or maleic anhydride; or a tricarboxylic acid such as trimellitic acid or anhydride thereof.

The polyester resin obtained from such acid component and alcohol component is suitable for the binder resin, as it provides a satisfactory fixing property and an excellent offset resistance in the toner for heat roller fixing.

The polyester resin has an acid value preferably of 90 mgKOH/g or less, more preferably 50 mgKOH/g, and an OH value preferably of 50 mgKOH/g or less, more preferably 30 mgKOH/g. This is because an increase the number of the terminal groups in the molecular chain increases the environment dependence in the charging property of the toner.

Also the polyester resin has a glass transition temperature preferably of 50 to 75° C., more preferably 55 to 65° C., a number-averaged molecular weight (Mn) preferably in a range of 1,500 to 50,000, more preferably 2,000 to 20,000 and a weight-averaged molecular weight (Mw) preferably in a range of 5,000 to 100,000, more preferably 10,000 to 90,000.

The toner of the present invention may be used if necessary in combination with a charge control agent in order to further stabilize the charging property. The charge control agent is employed in an amount of 1 to 10 parts by mass with respect to 100 parts by mass of the binder resin, more preferably 0.1 to 5 parts by mass.

Examples of the charge control agent are shown in the following.

As a negative chargeability control agent for maintaining the toner at a negatively chargeable property, a polymer, an organometallic complex or a chelate compound including for example a sulfonic acid group is effective. There can be employed a monoazo metal complex, a metal complex of an aromatic hydroxycarboxylic acid or a metal complex of aromatic dicarboxylic acid type. In addition there may be employed an aromatic hydroxycarboxylic acid, an aromatic mono- or poly-carboxylic acid or a metal salt, an anhydride or an ester thereof, or a phenol derivative of bisphenol.

As a positive chargeability control agent for maintaining the toner at a positively chargeable property, there can be employed nigrosin or a denatured product thereof for example with a fatty acid metal salt, a quaternary ammonium salt such as tributylbenzylammonium-1-hydroxy-4-naphthosulfonic acid salt or tetrabutylammonium tetrafluoroborate, a similar onium salt such as a phosphonium salt, a chelate pigment thereof such as a triphenylmethane dye or a rake pigment thereof (employing a raking agent such as phosphotungstenic acid, phosphomolybdenic acid, phototungstenmolybdenic acid, tannic acid, lauric acid, gallic acid, ferricyanic acid, ferrocyan compound etc.), or a higher fatty acid metal salt for example a diorganotin oxide such as dibutyltin oxide, dioctyltin oxide or dicyclohexyltin oxide, or a diorganotin borate such as dubutyltin borate, dioctyltin borate or dicyclohexyltin borate.

In case the toner of the present invention is used as magnetic toner, a magnetic material to be contained in the magnetic toner can be an iron oxide such as magnetite, maghemite or ferrite; an iron oxide containing another metal oxide; a metal such as Fe, Co or Ni; an alloy of such metal with another metal such as Al, Co, Cu, Pb, Mg, Ni, Sn, Zn, Sb, Be, Bi, Cd, Ca, Mn, Se, Ti, W or V, or a mixture thereof.

More specifically, the magnetic material can be, for example, triiron tetraoxide ($Fe_3O_4$), diiron trioxide ($\gamma$-$Fe_2O_3$), iron zinc oxide ($ZnFe_2O_3$), iron yttrium oxide ($Y_2Fe_5O_{12}$), iron cadmium oxide ($CdFe_2O_4$), iron gadolinium oxide ($Gd_3Fe_3O_{12}$), iron copper oxide ($CuFe_2O_4$), iron lead oxide ($PdFe_{12}O_{18}$), iron nickel oxide ($NiFe_2O_4$), iron neodymium oxide ($NdFe_2O_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), iron powder (Fe), cobalt powder (Co), or nickel powder (Ni). The above-mentioned magnetic materials are used singly or in a combination of two or more kinds. A particularly preferred magnetic material is fine powder of triiron tetraoxide or $\gamma$-diiron trioxide.

Such ferromagnetic material preferably has an average particle size of 0.05 to 2 $\mu$m, and magnetic properties under the application of 795.8 kA/m with a coercive force of 1.6 to 12.0 kA/m, a saturation magnetization of 50 to 200 $Am^2/kg$ (more preferably 50 to 100 $Am^2/kg$) and a retentive magnetization of 2 to 20 $Am^2/kg$.

With respect to 100 parts by mass of the binder resin, the magnetic material is used in an amount of 10 to 200 parts by mass, preferably 20 to 150 parts by mass.

A non-magnetic coloring agent usable in the toner of the present invention can a pigment or a dye arbitrary selected. The pigment can be, for example, carbon black, aniline black, acetylene black, naphthol yellow, Hanza yellow, thodamine rake, alizaline rake, red ocher, phthalocyanine blue or indanthrene blue.

Such pigment can be added in an amount of 0.1 to 20 parts by mass, preferably 1 to 10 parts by mass, with respect to 100 parts by mass of the binder resin. Also a dye can be used similarly, such as an anthraquinone dye, a xanthene dye or a methyne dye, employed in an amount of 0.1 to 20 parts by mass, preferably 0.3 to 10 parts by mass, with respect to 100 parts by mass of the binder resin.

In the present invention, one or plural releasing agents may be included in the toner particle if necessary. Examples of the releasing agent are shown in the following.

There may be employed an aliphatic hydrocarbon wax such as low molecular weight polyet, low molecular weight polypropylene, microcrystalline wax or paraffin wax; an oxidation product of an aliphatic hydrocarbon wax such as oxidized polyethylene wax; a wax containing a fatty acid ester as a main component such as carnauba wax, sazol wax, or montanic acid ester wax; or a wholly or partially deacidized product of a fatty acid ester such as deacidized carnauba wax.

There can also be employed a saturated straight-chain fatty acid such as palmitic acid, stearic acid or montanic acid; an unsaturated fatty acid such as brassidic acid, eleostearic acid, or valinalic acid; a saturated alcohol such as stearyl alcohol, aralkyl alcohol, behenyl alcohol. carnaubyl alcohol, ceryl alcohol or melyl alcohol; a long-chain alkyl alcohol; a polyhydric alcohol such as sorbitol; a fatty acid amide such as rinolyl amide, oleyl amide or lauryl amide; a saturated fatty acid bisamide such as methylene bisstearyl amide, ethylene biscapryl amide, ethylene bislauryl amide or hexamethylene bisstearyl amide; an unsaturated fatty acid amide such as ethylene bisoleyl amide, hexamethylene bisoleyl amide, N,N'-dioleyladipyl amide, or N,N-dioleylcebasyl amide; an aromatic bisamide such as m-xylene bisstearyl amide, or N,N-distearyl isophthalyl amide; a fatty acid metal salt (generally called metal soap) such as calcium stearate, calcium laurate, zinc stearate or magnesium stearate; a wax formed by grafting an aliphatic hydrocarbon wax with a vinyl monomer such as styrene or acrylic acid; a partial ester of a fatty acid and a polyhydric alcohol such as behenic acid monoglyceride; or a methyl ester compound having a hydroxy group obtained by hydrogenation of a vegetable oil or fat.

The amount of the releasing agent is 0.1 to 20 parts by mass, preferably 0.5 to 10 parts by mass with respect to 100 parts by mass of the binder resin.

Such releasing agent can be included in the binder resin by a method of dissolving the resin in a solvent, then elevating the temperature of the resin solution and adding and mixing the releasing agent under agitation, or a method of mixing the releasing agent at the kneading.

An abrasive or a fluidity improving agent may be added to the toner of the present invention. The abrasive can be, for example, a metal oxide (such as strontium titanate, cerium oxide, aluminum oxide, magnesium oxide or chromium oxide), a nitride (such as silicon nitride), a carbide (such as silicon carbide), or a metal salt (such as calcium sulfate, barium sulfate or calcium carbonate).

A fluidity improving agent is externally added to the toner thereby increasing the fluidity thereof in comparison with a state prior to the addition. It can be, for example, powder of a fluorinated resin such as fine powder of vinylidene fluoride, or fine powder of polytetrafluoroethylene; finely powdered silica such as wet process silica, or dry process silica; finely powdered titanium oxide; finely powdered alumina; or process silica obtained by surface treatment of these materials with a silane coupling agent, a titanium coupling agent or silicone oil.

A preferred fluidity improving agent is fine powder generated by vapor-phase oxidation of silicon halide, so-called dry process silica or fumed silica. It is for example formed utilizing a pyrolysis oxidation reaction of silicon tetrachloride gas in an oxygen-hydrogen flame, based on a following reaction formula:

$$SiCl_2+2H_2+O_2 \rightarrow SiO_2+4HCl$$

In this process, it is also possible to use another metal halide such as aluminum chloride or titanium chloride in combination with silicon halide thereby obtaining complex powder of silica and another metal oxide, and such complex powder is included also in silica. The finely powdered silica preferably has a particle size, in an average primary particle size, within a range of 0.001 to 2 $\mu$m, particularly preferably 0.002 to 0.2 $\mu$m.

The finely powdered silica generated by vapor-phase oxidation of silicon halide is commercially available for example under following trade names:

AEROSIL (TM) (Japan Aerosil Co.)
130, 200, 300, 380, TT600, MOX170, MOX80, COK84

Cab-O-Sil (CABOT Co.)
M-5, MS-7, MS-75, HS-5, EH-5

Wacker HDK (TM) N 20 (WACKER-CHEMIE GMBH)
V15, N20E, T30, T40

D-C Fine Silica (Dow Corning Co.) and

Fransol (Fransil Co.).

More preferred is processed silica fine powder, obtained by a hydrophobic treatment of silica fine powder formed by gaseous phase oxidation of silicon halide. In such processed silica fine powder, particularly preferred is silica fine powder which is so processed as to have a hydrophobicity, measured by a methanol titration test, within a range of 30 to 80.

The hydrophobicity can be provided by a chemical treatment with an organic silicon compound which reacts with or is physically adsorbed by the silica fine powder. In a preferred method, the fine powder silica formed by vapor-phase oxidation of silicon halide is treated with an organic silicon compound.

Such organic silicon compound can be, for example, hexamethyl silazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, triorganisilylmercaptane, trimethylsilylmercaptane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, or dimethylpolysiloxane having 2 to 12 siloxane units per molecule and a Si-bonded hydroxyl group in each terminal unit. There can also be employed silicone oil such as dimethylsilicone oil. These materials may be used singly or in a combination of two or more kinds.

The fluidity improving agent providing a satisfactory result has a specific surface area, measured by a BET method utilizing nitrogen adsorption, of 30 $m^2/g$ or higher, preferably 50 $m^2/g$ or higher. The fluidity improving agent is employed in an amount of 0.01 to 8 parts by mass, preferably 0.1 to 4 parts by mass, with respect to 100 parts by mass of the toner.

In the following there will be given an explanation on the method of measuring various physical property data, used in examples.

(1) Measurement of Particle Size Distribution

The particle size distribution can be measured in various methods, but, in the present invention, is measured utilizing a Coulter Counter Multi-sizer.

A measuring apparatus, Coulter Counter Multi-sizer (Coulter Inc.) is connected to an interface (Nikkaki Co.) for providing a number distribution and a volume distribution, and a personal computer CX-1 (Canon Inc.), and a 1% NaCl aqueous solution is prepared as electrolyte with special grade or first grade sodium chloride. At the measurement, 100 to 150 ml of the above-mentioned electrolyte solution is added with a surfactant (preferably an alkylbenzene sulfonate salt) as a dispersant in an amount of 0.1 to 5 ml, and further with a sample to be measured in an amount of 2 to 20 ml. The electrolyte solution in which the sample is suspended is subjected to a dispersion process for 1 to 3 minutes in an ultrasonic dispersing device, and the measurement is executed with the aforementioned Coulter Counter Multi-sizer II with an aperture of 100 μm in case of measuring the particle size of toner and 13 μm in case of measuring the particle size of inorganic fine powder. A volume and a number are measured for each of the toner and the inorganic fine powder to calculate a volume distribution and a number distribution. Then there is determined a weight-averaged diameter based on weight determined from the volume distribution.

(2) Measurement of Melting Point of Wax

Measurement is executed with a differential scanning calorimetry analyzer (DSC analyzer) DSC-7 (Perkin Elmer), and according to ASTMD3418-82. A precisely weighed measurement sample of 2 to 10 mg is placed in an aluminum pan, and is measured in an environment of a normal temperature and a normal humidity, with a measurement temperature range of 30 to 200° C. and a temperature elevating rate of 10° C./min, employing an empty aluminum pan as a reference. In such temperature elevating process, there is obtained a main heat absorption peak within a range of 30 to 200° C. A temperature of such main heat absorption peak is regarded as the melting point of the wax.

(3) Measurement of Glass Transition Temperature (Tg)

Measurement is executed with a differential scanning calorimetry analyzer (DSC analyzer) DSC-7 (Perkin Elmer), and according to ASTMD3418-82.

A measurement sample of 5 to 20 mg, preferably 10 mg, is precisely weighed.

The sample is placed in an aluminum pan, and is measured in an environment of a normal temperature and a normal humidity, within a measurement temperature range of 40 to 100° C. and a temperature elevating rate of 10° C./min, employing an empty aluminum pan as a reference.

In such temperature elevating process, there is obtained a main heat absorption peak with a range of 30 to 200° C. A crossing point of a line passing through an intermediate point of base lines before and after the heat absorption peaks and the differential thermal analysis curve is regarded as the glass transition temperature Tg in the present invention.

(4) Measurement of Molecular Weight Distribution of Raw Material of Binder Resin The molecular weight is determined from a chromatogram of GPC (gel permeation chromatography) measured under following conditions.

A column is stabilized in a heat chamber of 40° C., and tetrahydrofuran (THF) is passed as a solvent at a rate of 1 ml/min through the column of such temperature. After a sample is dissolved in THF, the obtained solution is filtered with a 0.2 μm filter, and an obtained filtrate is used as a measurement sample. Measurement is executed by injecting 50 to 200 μl of a THF solution of a resin, adjusted to a concentration of 0.05 to 0.6 mass %. At the molecular weight measurement of the sample, a molecular weight distribution is calculated from a relationship between a logarithmic value and a number count in a calibration line prepared with several monodispersion polystyrene samples.

For preparing the calibration line, there are employed standard polystyrene samples for example prepared by Pressure Chemical Co. or Tokyo Soda Industries Co. with molecular weights of $6\times10^2$, $2.1\times10^3$, $4\times10^3$, $1.75\times10^4$, $5.1\times10^4$, $1\times10^5$, $3.9\times10^5$, $8.6\times10^5$, $2\times10^6$ and $4.48\times10^6$ and it is preferred to employ standard polystyrene samples of at least 10 points. An RI (refractive index) detector is employed for detection.

For precisely measuring a molecular weight range of $10^3$ to $2\times10^6$, it is desirable to use a plurality of commercially available polystyrene gel columns in combination, and, for example, there is preferred a combination of μ-Styragel 500, $10^3$, $10^4$ and $10^5$ of Waters Inc. or a combination of Shodex KA-801, 802, 803, 804, 805, 806 and 807 of Showa Denko Inc.

In the following, the present invention will be further clarified by examples and comparative examples.

FIG. 1 shows, as explained in the foregoing, the configuration of an image forming apparatus in which a recording sheet (transfer sheet) is conveyed in a vertical direction (direction of gravity) from below to above. This image forming apparatus is a laser printer utilizing transfer type electrophotography, and functions as an image forming apparatus of the present invention, which will be explained in further details. Referring to FIG. 1, an electrophotographic photosensitive member 72 of rotary drum type (hereinafter represented as photosensitive drum) constituting an image bearing member is rotated counterclockwise as indicated by an arrow R at a predetermined peripheral speed (process speed). Charging means 73 is constituted by a charging roller in the present embodiment, but there may be employed other charging means such as a brush charger or a corona charger.

Exposure means 74 constituting information writing means is constituted by a laser scanner (optical signal generating apparatus) which emits a laser light L modulated according to an electric digital image signal constituting image information from a host equipment (not shown) such as a computer or an image reader. A uniformly charged surface of the rotating photosensitive drum is scan exposed by the exposure means 74, whereby a potential of the photosensitive drum is attenuated in an exposed portion to form an electrostatic latent image corresponding to the exposed pattern.

In developing means 75, a developing roller 75*a* develops the electrostatic latent image, formed on the surface of the rotating photosensitive drum 72, as a toner image. A transfer roller 79 constituting transfer means is pressed under a predetermined pressure to the photosensitive drum 72 to form a transfer nip portion.

A sheet cassette 76 contains a stack of recording sheets (transfer sheets). A recording sheet P is separated and fed at a predetermined control timing from the sheet cassette 76 and is supplied to the transfer nip portion at a predetermined control timing. The recording sheet P supplied to the transfer nip portion is conveyed by being pinched therein, and a predetermined transfer bias is applied to the transfer roller 79 whereby the toner image on the surface of the photosensitive drum 72 is electrostatically in succession onto the recording sheet P.

The recording sheet P after emerging from the transfer nip portion is separated from the surface of the photosensitive drum 72, and introduced into heat and/or pressure fixing means 81 for fixation of the toner image and is discharged as an image bearing sheet (copy or print) by paired discharge rollers 82 onto a discharge tray 94 provided outside the apparatus.

There is provided a blade-type cleaning apparatus 83. After the separation of the recording sheet, the surface of the photosensitive drum is wiped by a cleaning blade 84 whereby the surface of the photosensitive drum 72 is cleaned by elimination of retentive toner (retentive developer) and the photosensitive drum 72 with the cleaned surface is again used in image formation.

The image forming apparatus of the present embodiment has a configuration in which the recording sheet (transfer sheet) P is conveyed from below to above in the vertical direction (direction of gravity), whereby an aperture of the cleaning apparatus 83 is directed downwards in the direction of gravity as shown in FIG. 1. As illustrated, a line c which connects a contact position of the cleaning blade 84 (material: polyurethane, hardness: 65°, front end thickness: 1.2 mm, width: 320 mm, length (length of free portion): 7 mm) with the photosensitive drum 72 and a center O of the photosensitive drum 72 and a line e which connects a highest point d of the photosensitive drum with respect to the horizontal plane and the center O of the photosensitive drum form an angle $\alpha$ of 15°, and a tangential direction f of the photosensitive drum 72 at the contact position b and a plane g of the cleaning blade 84 form a contact angle (penetration angle) $\beta$ of 24°.

T indicates transfer retentive toner on the photosensitive drum 2, scraped off by the front end portion of the cleaning blade 84. There is provided a scooping sheet 86 for preventing leakage of the toner T to the outside of the cleaning unit. The cleaning blade 84 is in fact bent at the contact position b, but the plane g of the cleaning blade is considered in an imaginary unbent line in defining the angle. $\delta$ indicates a penetration amount of the cleaning blade 84 into the photosensitive drum 72, and is set at 0.7 in the present embodiment. The photosensitive drum 72 has a diameter of 30 mm, and a distance $\gamma$ between the front end of the cleaning blade and the front end of the scooping sheet is set at 2 mm.

The toner accumulated in the cleaning apparatus 83 of the present embodiment is conveyed, by the rotation of a conveying screw 103 (FIG. 1) provided parallel to the rotary axis of the photosensitive drum 72, from a front side toward a rear side of the plane of the drawing, and is discharged into an unrepresented used toner recovery box provided inside a main body of the image forming apparatus.

Figure 5:
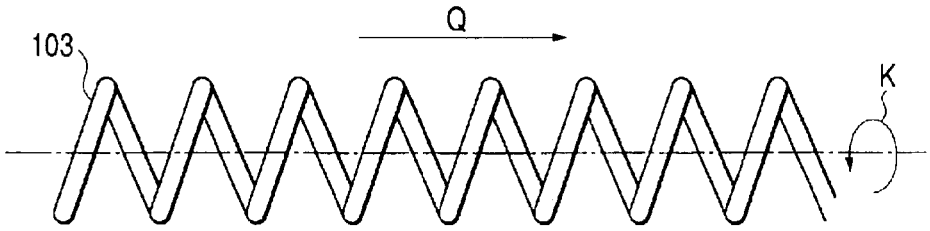
FIG. 5 is a view showing toner carrying means.

FIG. 5 is an external view of the conveying screw 103. The conveying screw 103 has a shape of a coil spring, and conveys the used toner in a direction Q by a rotation in a direction k. The conveying screw 103 is formed by a SWIC material with a wire diameter of $\phi$2, a spring diameter of $\phi$14, a spring pitch 10, and a revolution 2 rpm.

(Toner Example)

A composition of following materials:

Binder resin (polyester resin): 100 parts by mass
(Tg: 59° C., acid value: 19 mgKOH/g, hydroxyl group value: 30 mgKOH/g, molecular weight Mp: 7,000, Mn: 2,800, Mw: 53,000);

Magnetic iron oxide: 90 parts by mass;
(average particle size: 0.23 $\mu$m, characteristics under a magnetic field of 795.8 kA/m, Hc: 9.2 kA/m, $\sigma$s: 81.5 $Am^2/kg$, $\sigma$r: 11/3 $Am^2/kg$);

Azo type iron complex compound: 2 parts by mass; and

Low molecular weight ethylene-propylene copolymer: 3 parts by mass;

were well mixed in a Henschel mixer (FM-75, manufactured by Mitsui Miike Chemical Engineering Equipment Co.) and kneaded in a two-shaft kneader (PCM-30, Ikegai Tekko Co.), set at a temperature of 130° C. A kneaded substance thus obtained was cooled and subjected to a crude crushing to a size of 1 mm or less with a hammer mill, whereby a powder material (A)(crude crushed material) was obtained as a material for producing toner.

The powder material (A) was crushed with a turbo mill T-250 (Turbo Kogyo Co.), and was classified with an elbow jet (Nittetsu Mining Co.).

A medium powder material A-1 (classified) obtained in the aforementioned classifying step had a weight-averaged particle size of 6.5 $\mu$m, and a sharp particle size distribution containing particles of a size of 4.0 $\mu$m or less by 20.3 number % of all the particles, and particles of a size of 10.1 $\mu$m or more by 3.7 volume %. Result of particle size measurement is shown in Table 1.

TABLE 1

Results of particle size measurement of medium powder substance (toner particles) with Coulter Counter Multi-Sizer

| Sample | Weight-averaged Diameter ($\mu$m) | 4.0 $\mu$m or less (num. %) | 10.1 $\mu$m or larger (vol. %) |
|---|---|---|---|
| A-1 | 6.5 | 20.5 | 3.8 |
| N-1 | 6.5 | 23.3 | 5.1 |

To 1,100 parts by mass of the medium powder A, 1.2 parts by mass of hydrophobic silica fine power (BET 300 $m^2/g$) were externally added with a Henschel mixer to obtain a toner for evaluation (No.1). Table 2 shows the particle size thereof.

TABLE 2

Particle size of toners with external addition (toners for evaluation)

| Sample | Weight-averaged Diameter | 4.0 μm or less (num. %) | 10.1 μm or larger (vol. %) |
|---|---|---|---|
| No. 1 | 6.5 | 20.5 | 3.9 |
| No. 2 | 6.6 | 24 | 5.3 |

In a measurement of this toner with FPIA 1000, particles of a circularity a=0.900 or higher represented 95.7 number %, and those of a circularity a=0.950 or higher represented 78.4 number % (Table 3).

Now the toner of a state shown in Table 3 is considered in a following relationship, explained in the foregoing:

For a number-based value Y of particles having the circularity a of 0.950 or higher:

$$Y \geqq \exp 5.51 \times X^{-0.645} \quad (2)$$

Since the toner (No.1) of the example 1 has a weight-averaged diameter of 6.5 μm to provide a following result:

$$78.4 > \exp 5.51 \times (6.5)^{-0.645} = 73.9$$

so that the relationship (2) can be satisfied.

On the other hand, a toner (No.2) of a comparative example 1, including particles of a circularity a=0.950 or higher in 67.8 number % and a weight-averaged diameter of 6.6 μm to provide a following result:

$$67.8 > \exp 5.51 \times (6.6)^{-0.645} = 73.9$$

so that the relationship (2) cannot be satisfied.

TABLE 3

Result of circularity measurement of toner particles of example and comparative example with FPIA-1000

| | | Charge Control Agent | 0.900 or higher (%) | 0.950 or higher (%) |
|---|---|---|---|---|
| Example 1 | (No.1) | resin (a) | 95.7 | 78.4 |
| Comp. Ex. 1 | (No.2) | resin (a) | 94 | 67.8 |

Figure 6A:
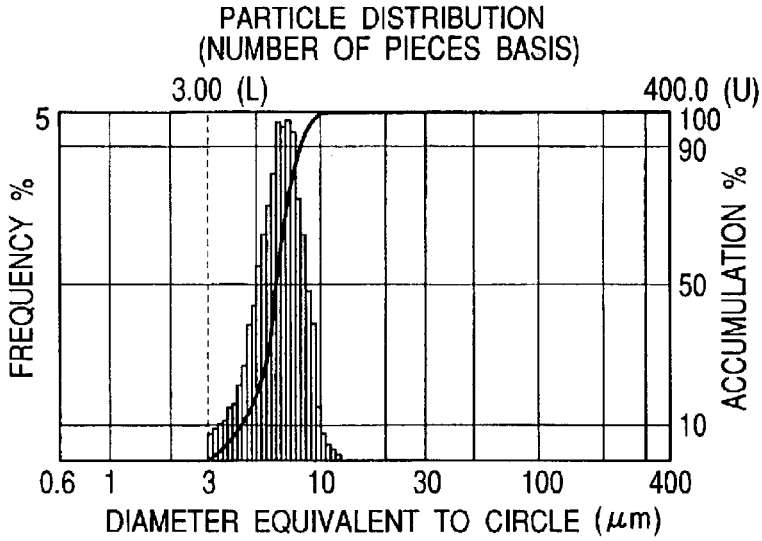
FIGS. 6A, 6B and 6C are charts respectively showing a particle size distribution, an equivalent circle diameter and a degree of circle (circularity) of a medium powder A-1.
Figure 6B:
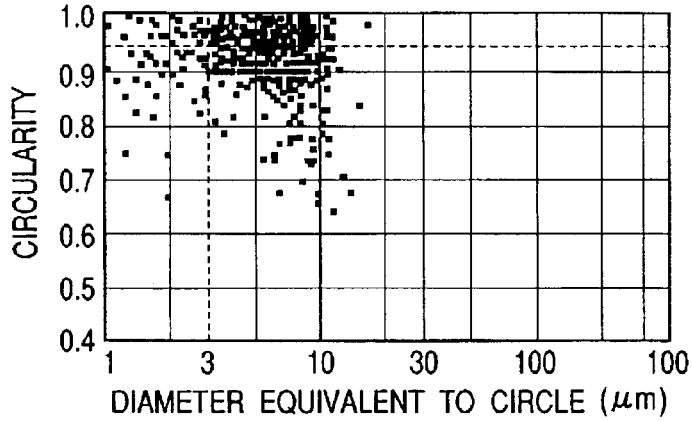
Figure 6C:
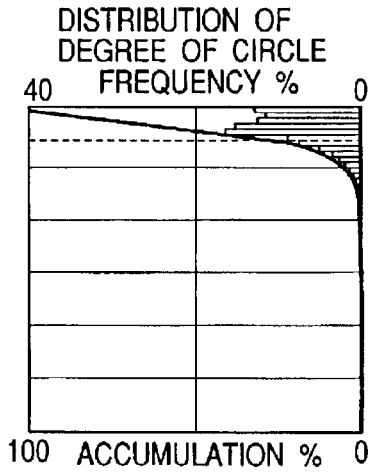

Also a particle concentration A (all particles) before cutting of the particles of 3 μm or less was 15,209.7 particle/μl, and a measured particle concentration B of the particles of 3 μm or higher was 13,028.3 particle/μl. Based on a measurement with FPIA 1000, a particle size distribution is shown in FIG. 6A, an equivalent circle diameter is shown in FIG. 6B and a circularity distribution is shown in FIG. 6C.

(Evaluation 1)

Three hundred and thirty grams of the toner for evaluation (No.1) were placed in a developing device of the image forming apparatus of the present example and was let to stand overnight (12 hours or more) in a room of a normal temperature and a normal humidity (23° C./50%). After the weight of the developing device was measured, it was installed in the image forming apparatus of this example, and the developing sleeve was rotated for 3 minutes. At this operation, a cleaner unit and a used toner recovery unit were taken out from the main body and were weighed. A printing operation of 500 sheets was executed with a test chart of a print ratio of 6%, and a transfer rate was calculated. The toner for evaluation (No.1) provided a transfer rate of 96%.

The transfer rate was calculated according to a following equation:

Transfer rate (%)=weight decrease in developing device−(weight increase in cleaner unit+weight increase in used toner recovery unit)/(weight decrease in developing device)×100(Evaluation 2)

After the measurement of the transfer rate as explained above, the image forming apparatus and the developing device of this example were moved to a room of a normal temperature and a low humidity (23° C./5%), then the developing device was taken out from the apparatus and was let to stand for 3 days. Thereafter the developing device was installed in the image forming apparatus of this example, and the developing sleeve was rotated for 1 minute. A printing operation of 10,000 sheets was executed with a test chart of a print ratio of 40%, with a solid white image formation for every 1,000 sheets and an ordinal number of copy at which a toner stain was generated on the image was inspected. The evaluation was made by using the aforementioned toner for evaluation (No.1) throughout all these operations, and modifying the angles α and β relating to the setting of the cleaning blade as explained in FIG. 2 and the distance γ (mm) from the contact position of the cleaning blade to the contact position of the scooping sheet. Results are shown by Examples 1 to 5 in Table 4.

TABLE 4

Evaluation of examples and comparative examples

| | α (°) | β (°) | γ (mm) | Number of copies at which toner stain was generated |
|---|---|---|---|---|
| Example 1 | 15 | 25 | 2 | not generated |
| Example 2 | 15 | 25 | 1 | not generated |
| Example 3 | 15 | 25 | 9 | 9,000 |
| Example 4 | −15 | 25 | 2 | not generated |
| Example 5 | 15 | 40 | 2 | 8,000 |
| Comp. Ex. 1 | 15 | 25 | 2 | 3,000 |
| Comp. Ex. 2 | 15 | 25 | 11 | 3,000 |
| Comp. Ex. 3 | 15 | 25 | 0.4 | 1,000 |
| Comp. Ex. 4 | 70 | 25 | 2 | 2,000 |

In examples 1, 2 and 4, an image stain was not at all generated in the evaluation on 10,000 sheets.

In an example 3, because of a larger value of γ leading to a toner leaking tendency, an image stain was generated at 9,000th sheet, but the durability was in a practically acceptable range.

In an example 5, because of a larger value of β resulting in a somewhat unstable contact state of the blade, an image stain was generated at 8,000th sheet, but the durability was in a practically acceptable range.

In the configuration of the present invention explained in the foregoing, the use of substantially spherical toner of a high transfer efficiency allows to prevent entry of a large amount of toner in the cleaning unit, thereby effectively avoid generation of cleaning defect even in case the aperture of the cleaning container is directed downwards in the direction of gravity. It also allows, in comparison with a conventional configuration, to expand an appropriate setting range of the cleaning blade and the scooping sheet.

COMPARATIVE EXAMPLE 1

The powder material (A) was crushed with an IDS mill (Nippon Pneumatic Industries Co.) and was classified with an elbow jet (Nittetsu Mining Co.).

A medium powder material N-1 (classified) obtained in the aforementioned classifying step had a weight-averaged particle size of 6.6 μm, and a particle size distribution containing particles of a size of 4.0 μm or less by 23.8 number %, and particles of a size of 10.1 μm or more by 5.4 volume %. Result of particle size measurement is shown in Table 1.

To 1,100 parts by mass of the medium powder N, 1.2 parts by mass of hydrophobic silica fine power (BET 300 $m^2/g$) were externally added with a Henschel mixer to obtain a toner for evaluation (No.2). The particle size is shown in Tab. 2.

Figure 7A:
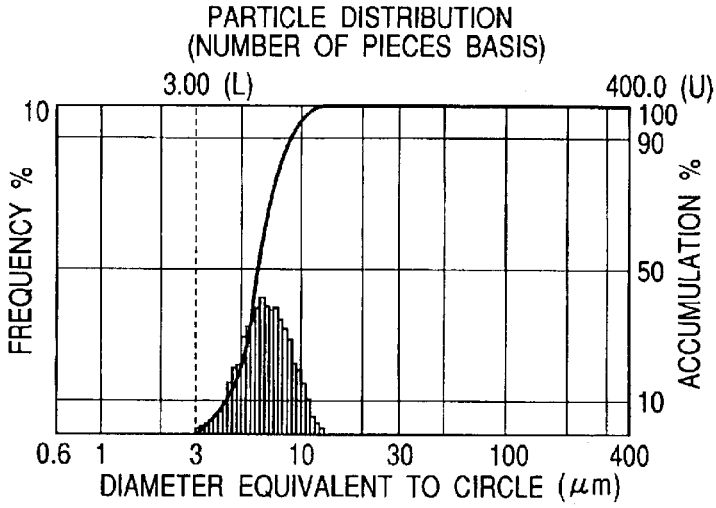
FIGS. 7A, 7B and 7C are charts respectively showing a particle size distribution, an equivalent circle diameter and a degree of circle (circularity) of a medium powder N-1.
Figure 7B:
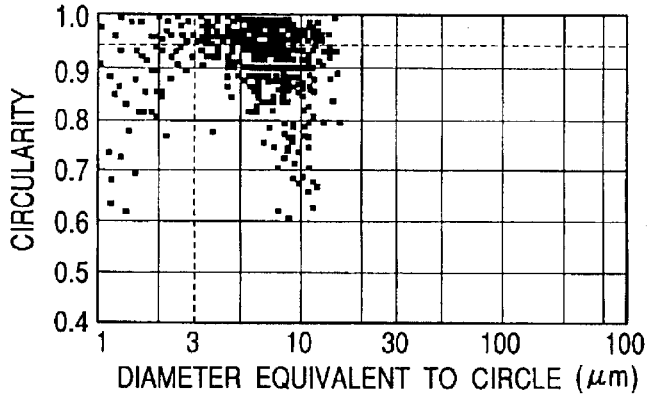
Figure 7C:
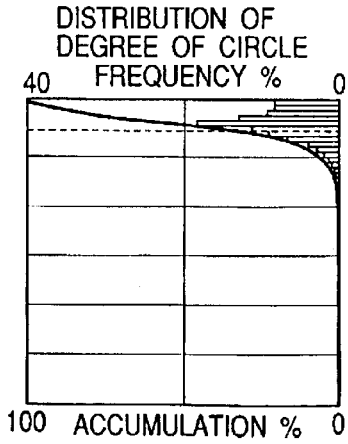

In a measurement of this toner with FPIA 1000, particles of a circularity a=0.900 or higher represented 94.0 number %, and those of a circularity a=0.950 or higher represented 67.8 number % (Table 3). Based on a measurement with FPIA 1000, a particle size distribution is shown in FIG. 7A, an equivalent circle diameter is shown in FIG. 7B and a circularity distribution is shown in FIG. 7C.

The toner was evaluated as in the example 1 to obtain a result shown in Tab. 4. Though the setting of the cleaning blade and the scooping sheet was same as in the example 1, a difference in the toner resulted in an image stain as early as 3,000th sheet.

COMPARATIVE EXAMPLES 2 to 4

Evaluations were made in a similar manner as in the example 1, employing cleaning conditions shown in Table 4 with the toner for evaluation (No.1) as in the example 1 to obtain results shown in Table 4.

In a comparative example 2, since an excessively large γ value of 11 mm facilitates toner leakage, an image stain was generated as early as 3,000th sheet.

In a comparative example 3, since an excessively small γ value of 0.4 mm caused an interference of the cleaning blade and the scooping sheet tending to cause a cleaning defect, an image stain was generated as early as 1,000th sheet.

In a comparative example 4, since an a value of 70° caused a blade contact at a side face of the drum, whereby a sufficient amount of toner cannot be maintained in the aperture portion of the cleaning container to result in an unstable cleaning state, and an image stain was generated as early as 2,000th sheet.

What is claimed is:

1. An image forming apparatus comprising:

transferring means for transferring a developer image on an image bearing member onto a transferring material; and a blade abutting on the image bearing member in a direction opposite to a rotation direction, for removing developer on the image bearing member, wherein a weight-averaged particle diameter of the developer is in a range of 5 μm≦X≦12 μm, wherein in the developer, among particles having a particle size of 3 μm of larger such include particles having a circularity of 0.90 or larger by 90% or more in a number-based cumulative value, in a case that the circularity is determined by a value in which a circumferential length of a circle having a projection area, which is the same as a projection area of a particle image, is divided by a circumferential length of the particle image, and wherein said blade is provided under the developer removed by said blade to collect the removal of developer at a portion where said image bearing member abuts onto said blade.

2. An apparatus according to claim 1, wherein an angle β formed by a tangential line at a portion where said blade abuts onto said image bearing member and said blade is in a range of 20°<α<30°.

3. An apparatus according to claim 1, wherein said developer is produced by a crushing method.

* * * * *

UNITED STATES PATENT AND TRADEMARK OFFICE

CERTIFICATE OF CORRECTION

PATENT NO. : 6,819,905 B2
DATED : November 16, 2004
INVENTOR(S) : Mitsuru Yamatani It is certified that error appears in the above-identified patent and that said Letters Patent is hereby corrected as shown below:

Column 1,
Line 64, “continues,” should read -- continues --.

Column 2,
Line 25, “method etc.” should read -- method, etc. --.

Column 3,
Line 39, “conditions” should read -- condition --.

Column 4,
Line 34, “with” should read -- that is --.

Column 7,
Lines 13 and 25, “binyl” should read -- vinyl --; and
Line 51, “tetraethyelene” should read -- tetraethylene --.

Column 8,
Line 14, “polyvinylbutyral, rosin,” should read -- polyvinylbutyral resin, --;
Line 15, “rosin,” should read -- resin, --;
Line 16, “resin etc.” should read -- resin,etc. --; and
Line 57, “part,” should read -- part --.

Column 9,
Line 27, “14-butadediol,” should read -- 1, 4-butanediol, --.

Column 10,
Line 16, “increase” should read -- increase in --; and
Line 56, “compound” should read -- compound, --.

Column 11,
Line 2, “diiron” should read -- γ-diiron --
Line 25, “can” should read -- can be --; and “arbitrary” should read -- arbitrarily --;
Line 28, “thodamine rake, alizaline rake,” should read -- rhodamine lake, alizarine lake,--; and
Line 53, “alcohol.” should read -- alcohol, --.

Column 16,
Line 66, “power” should read -- powder --.

UNITED STATES PATENT AND TRADEMARK OFFICE

CERTIFICATE OF CORRECTION

PATENT NO. : 6,819,905 B2
DATED : November 16, 2004
INVENTOR(S) : Mitsuru Yamatani It is certified that error appears in the above-identified patent and that said Letters Patent is hereby corrected as shown below:

Column 17,
In Table 2, line 9, "Diameter" should read -- Diameter ($\mu$m) --.

Column 18,
In Table 2, line 9, "Diameter" should read -- Diameter ($\mu$m) --.

Column 19,
Line 9, "power" should read -- powder --; and
Line 22, "was" should read -- was the --.

Column 20,
Line 1, "an a" should read -- an $\alpha$ --; and
Line 19, "of" should read -- or --.

Signed and Sealed this

Twenty-sixth Day of April, 2005

JON W. DUDAS
*Director of the United States Patent and Trademark Office*